US007707746B2

(12) United States Patent
Dean

(10) Patent No.: US 7,707,746 B2
(45) Date of Patent: May 4, 2010

(54) FOOTWEAR OUTSOLE CONSTRUCTION

(76) Inventor: Norman C. Dean, 14 Dr. Fink Rd., Pleasant Valley, NY (US) 12569

( * ) Notice: Subject to any disclaimer, the term of this patent is extended or adjusted under 35 U.S.C. 154(b) by 605 days.

(21) Appl. No.: 11/650,610

(22) Filed: Jan. 8, 2007

(65) Prior Publication Data

US 2008/0163511 A1 Jul. 10, 2008

(51) Int. Cl.
*A43B 21/26* (2006.01)

(52) U.S. Cl. ..... 36/35 R; 36/37; 36/35 B

(58) Field of Classification Search ..... 36/35 R, 36/37, 35 B, 28, 29
See application file for complete search history.

(56) References Cited

U.S. PATENT DOCUMENTS

| | | | | |
|---|---|---|---|---|
| 2,885,797 | A * | 5/1959 | Chrencik | 36/91 |
| 3,785,070 | A | 1/1974 | Stafford | |
| 4,235,028 | A * | 11/1980 | Riggs | 36/80 |
| 4,942,679 | A | 7/1990 | Brandon et al. | |
| 5,367,791 | A | 11/1994 | Gross et al. | |
| 5,465,507 | A | 11/1995 | Schumacher et al. | |
| 5,644,856 | A | 7/1997 | Bray, Jr. | |
| 5,689,902 | A | 11/1997 | Juang | |
| 5,933,982 | A | 8/1999 | Chen | |
| 5,996,251 | A | 12/1999 | LaDuca | |
| 6,050,001 | A | 4/2000 | Ditrtrich et al. | |
| 6,082,023 | A | 7/2000 | Dalton | |
| 6,205,683 | B1 | 3/2001 | Clark et al. | |
| 6,237,251 | B1 | 5/2001 | Litchfield et al. | |
| 6,266,896 | B1 * | 7/2001 | Liu | 36/28 |
| 6,519,874 | B1 | 2/2003 | Dean | |
| 6,691,432 | B2 | 2/2004 | Masseron | |
| 6,748,675 | B2 | 6/2004 | Sato | |
| 7,152,341 | B2 | 12/2006 | Dean | |
| 7,383,647 | B2 * | 6/2008 | Chan et al. | 36/28 |
| 2003/0061733 | A1 | 4/2003 | Karsten | |
| 2006/0026867 | A1 | 2/2006 | Polcek | |
| 2008/0092404 | A1 * | 4/2008 | Sokolowski et al. | 36/28 |

* cited by examiner

*Primary Examiner*—Ted Kavanaugh
(74) *Attorney, Agent, or Firm*—Joseph L. Spiegel; Heslin Rothenberg Farley & Mesiti P.C.

(57) ABSTRACT

An outsole for a footwear construction to provide added softness in the heel strike area of a foot while providing added stability to the outer edge of the outsole, comprises: a top layer contoured to the shape of a foot, thereby providing cradle support to the foot; and, a lower layer having a bottom most layer with a heel portion so constructed as to achieve different degrees of softness, the heel portion including a wedge-shaped piece positioned on the heel portion, positioned over the heel strike area and being of a softer durometer value material and having an outer edge of a harder durometer value material thereby providing added stability to the footwear construction and avoiding lateral collapsing. The top layer and bottom layer are cemented together, encapsulating the wedge-shaped piece in the footwear construction between the top layer and bottom most layer to form a stable walking platform for the footwear construction. The wedge shaped piece is apertured vertically, the number and size of the apertures in the wedge-shaped piece being larger than those in the outer edge area. The apertures in the wedge-shaped piece outer edge may be moon-shaped. A sock may be provided to cover the top contoured layer for added cushioning for a foot.

6 Claims, 1 Drawing Sheet

FOOTWEAR OUTSOLE CONSTRUCTION

BACKGROUND OF THE INVENTION

1. Field of the Invention

This invention relates to footwear construction and, in particular to the construction of a cushioning outsole for such footwear.

2. Description of the Prior Art

In most footwear construction, only the inside of the shoe is cushioned. Examples of same may be found in the following U.S. Patents or Published Applications: U.S. Pat. Nos. 6,205,683; 6,519,874; 7,152,341; and, US2003/0061733.

Yet there have been some attempts that may be viewed as attempts at cushioning on the outside of the shoe. Examples of same may be found in the following U.S. Pat. Nos. 4,942,679; 5,689,902; and, 6,050,001.

The present invention represents an improvement in the cushioning of the outside of the shoe, a cushioning outsole so as to minimize the adverse effects when the heel strikes a walking surface or ground.

SUMMARY

An object of the invention is to improve sole construction in footwear so as to improve the comfort of the wearer.

Another object is such a construction that is lightweight and shock absorbent at the heel strike area.

Still another object is sole construction that is comfortable to the wearer

These and other objects, features and advantages are accomplished in accordance with the teachings of the present invention, one illustrative embodiment of which comprises an outsole for a footwear construction to provide added softness in the heel strike area of a foot while providing added stability to the outer edge of the outsole. It comprises: a top layer contoured to the shape of a foot, thereby providing cradle support to the foot; and, a lower layer having a bottom most layer with a heel portion so constructed as to achieve different degrees of softness, the heel portion including a wedge-shaped piece positioned on the heel portion, positioned over the heel strike area and being of a softer durometer value material, and having an outer edge of a harder durometer value material, thereby providing added stability to the footwear construction and avoiding lateral collapsing. The top layer and bottom layer are cemented together, encapsulating the wedge-shaped piece in the footwear construction between the top layer and bottom most layer to form a stable walking platform for the footwear construction.

The wedge shaped piece is apertured vertically, the number and size of the apertures in the middle of the wedge-shaped piece being larger than those in the outer edge area. The apertures in the wedge-shaped piece outer edge may be moon-shaped. A sock may be provided to cover the top contoured layer for added cushioning for a foot.

BRIEF DESCRIPTION OF THE DRAWING

Other objects, features and advantages of the present invention will be apparent from the following detailed description and accompany drawing, wherein.

DETAILED DESCRIPTION

The heel strike area is the most drastic attack to the foot as you are walking and this invention is concerned with attempting to better cushion the foot as the heel strikes the walking surface.

Figure 1:
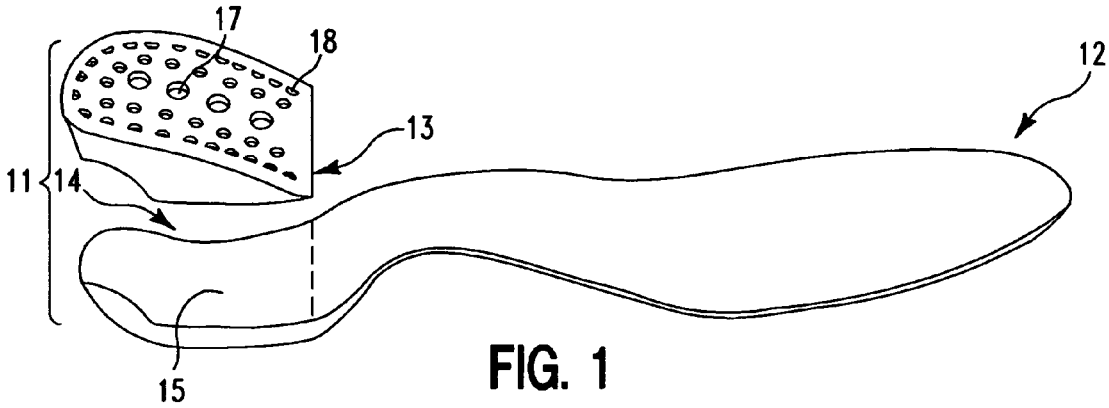
FIG. 1 is a side exploded perspective view of the lower layer of the footwear sole construction.

Referring now to the three figures of the drawing, these generally show the outsole of a shoe construction that, when combined with an upper, comprise the footwear. Referring in particular to FIG. 1, there is shown the outsole lower layer 11 of the outsole 10 that includes a bottom most, wear resistant walking surface layer 12 and wedge-shaped piece 13. The footwear normally includes an interior shank (not shown). The bottom surface of the layer 12 would be the surface that contacts the street, road or ground surface. It is typically made of a harder thermoplastic material, rubber, leather, thermal plastic rubber (TPR), poly vinyl chloride (PVC), polyurethane or ethylene-vinyl acetate (EVA) and combinations thereof The upper surface of the bottom layer 12 includes a heel portion 14 that includes a heel strike area 15.

The lower layer 11 further includes the wedge-shaped piece 13 to be positioned on the heel strike area 15 of the outsole heel portion 14. It may be of the same material as the bottom most layer 12 (which also serves to protect wedge 13 from abrasion) but softer because of its construction. The wedge-shaped piece 13 is apertured vertically, with the apertures 17 in the central most portion of the wedge 13 being larger than those apertures 18 in the outer areas as you extend outwardly from the central most area of the wedge-shaped piece 13. Typically, the apertures extend say 90% vertically through the wedge-shaped piece from the top down. Their length, depending on the size of the outsole can be anywhere from eight millimeters to two centimeters.

The apertures 17 are of circular cross section and of decreasing diameter as you move outwardly from the central most portion of the wedge. The central most apertures 17 may be seven to eight millimeters and go down from there to say five millimeters. The material of the wedge 13 is of softer material than the bottom most layer 12 because of its construction, and since you are walking on less material in this area, this gives you a bounce-back, cushioning effect to the heel portion of the foot.

The apertures 18 about the periphery of the wedge 13 may be moon-shaped, and are of smaller size, say seven to eight millimeters at their greatest length and half that dimension at their greatest width, resulting in a stiffer area about the periphery of the wedge than in its central portion, thus giving stability at the edges so, for example, the user doesn't fall over. Stated another way, the wedge 13 is softer in the center area due larger holes and firmer about the periphery because of smaller holes and more material The wedge-shaped piece may be made of poly-vinyl chloride (PVC), thermal plastic rubber (TPR), polyurethane or ethylene-vinyl acetate (EVA).

The heel wedge-shaped piece 13 is attached to layer 12 by cementing. However, if both are of the same material, they could be molded together.

In a typical embodiment, the durometer value of the heel portion is on the order of 60, in the center of the wedge 13 on the order of 15 and about the outer periphery of the wedge 13 on the order of 20.

Figure 2:
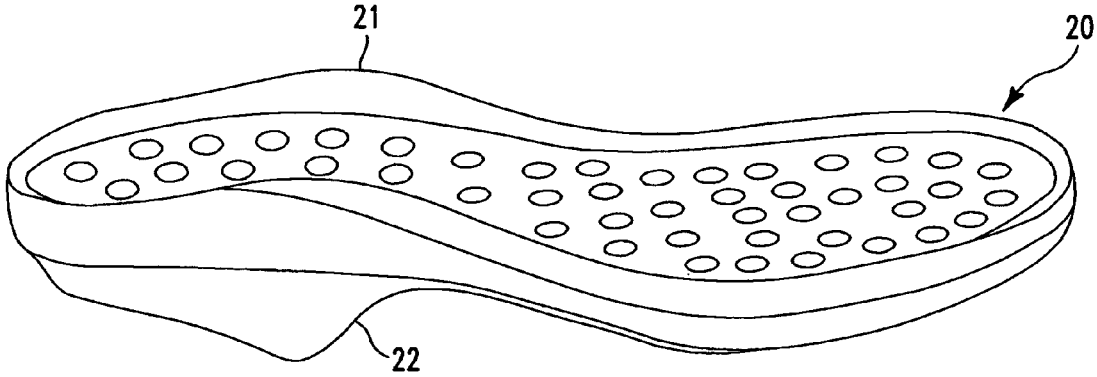
FIG. 2 is a perspective view of the top layer of the outsole.

FIG. 2 is the upper layer 20 of the outsole construction 10 and is the part that is attached to the upper of the footwear construction, as by cementing or stitching to the insole. It is of, for example, a lightweight, poly-urethane material or rubber, contoured at 21 to the shape of a user's foot for support, thereby providing cradle support to the user's foot. The cradle so formed is adapted to receive and may be covered by a cushioned sock (not shown) shaped to the contours of the layer 20. The sock would be a form of additional padding that would provide further cushioning to the foot. It can be made of leather, micro rubber or polyurethane.

Figure 3:
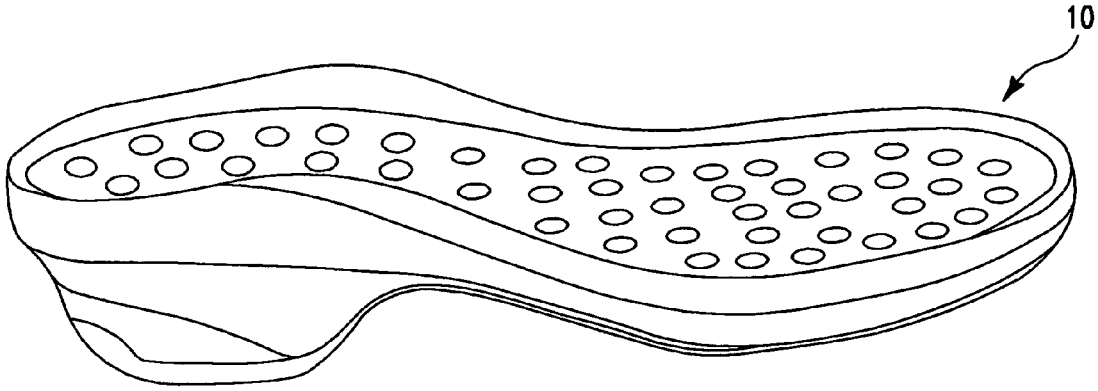
FIG. 3 is a perspective view of the completed footwear outsole construction.

FIG. 3 shows the completed footwear outsole construction 10. The lower layer 11 is cemented to the upper layer 20 encapsulating the wedge-shaped piece in the footwear construction between the top layer 20 and bottom most layer 12 to form a stable walking platform. Lower layer 11 and upper layer 20 are cemented together by using a heat activated cement. The parts are cemented and allowed to dry. They are then heat activated, pressed together and as the cement cools it forms the bond. The completed outsole typically is one quarter inch thick and extends the entire length of the footwear. The invention is useful with footwear such as a clog, dress shoe, walking shoe, sandal, boot, athletic shoe though not a performance athletic shoe and other forms of casual footwear. The heel is cushioned during normal gait by added softness to this area. The foot is supported by the cradle area 21 for stability The heel 22 can be of various heights. But even as you go up in heel height such as in women's shoes, the sole construction of the present invention is usable unlike prior art outsoles that were unstable due to soft materials used in construction that would crunch and fall over.

It should be obvious that changes, additions and omissions may be made in the details and arrangement of parts without departing from the spirit and scope of the invention as hereinafter claimed.

What is claimed is:

1. An outsole for a footwear construction to provide added softness in the heel strike area of a foot while providing added stability to the outer edge of the outsole, comprising:

a top layer; and, a lower layer having a bottom most layer with a heel portion so constructed as to achieve different degrees of softness, the heel portion including a heel strike area, and, a wedge-shaped piece positioned on the heel strike area, having a central area being of a softer durometer value material, and an outer edge of a harder durometer value material, thereby providing added stability to the footwear construction and avoiding lateral collapsing, the wedge-shaped piece being apertutured vertically, the number and size of the apertures in the wedge-shaped piece being larger than those in the outer edge area;

the top layer and bottom layer being cemented together, encapsulating the wedge-shaped piece on the heel strike area of the footwear construction between the top layer and bottom most layer to form a stable walking platform for the footwear construction.

2. The sole of claim 1 wherein the apertures in the wedge-shaped piece outer edge are moon-shaped.

3. The outsole of claim 1 wherein the apertures descend vertically mostly, but not completely, through the wedge-shaped piece.

4. The outsole of claim 1 wherein the top layer is contoured to the shape of a foot, thereby providing cradle support to the foot.

5. The outsole of claim 4 wherein the top layer is configured to receive a shank.

6. The outsole of claim 4 wherein the top layer is configured to receive a sock.

* * * * *